US005756244A

United States Patent [19]

Omatsu et al.

[11] Patent Number: 5,756,244

[45] Date of Patent: May 26, 1998

[54] TONER FOR FULL-COLOR ELECTROPHOTOGRAPHY AND METHOD FOR FORMING FIXED IMAGES USING THE SAME

[75] Inventors: Shinichiro Omatsu; Tetsuhiro Semura, both of Wakayama, Japan

[73] Assignee: Kao Corporation, Tokyo, Japan

[21] Appl. No.: 596,428

[22] Filed: Feb. 2, 1996

[30] Foreign Application Priority Data

Feb. 16, 1995 [JP] Japan ..... 7-053371

[51] Int. Cl.[6] ..... G03G 13/01; G03G 9/087; G03G 9/097

[52] U.S. Cl. ..... 430/45; 430/109; 430/110; 430/111; 430/903

[58] Field of Search ..... 430/110, 109, 430/111, 903, 45

[56] References Cited

U.S. PATENT DOCUMENTS

| | | | |
|---|---|---|---|
| 4,387,211 | 6/1983 | Yasuda et al. | 528/179 |
| 4,657,837 | 4/1987 | Morita et al. | 430/109 |
| 5,143,809 | 9/1992 | Kaneko et al. | 430/110 |
| 5,256,512 | 10/1993 | Kobayashi et al. | 430/45 |
| 5,578,409 | 11/1996 | Kotaki et al. | 430/109 |

FOREIGN PATENT DOCUMENTS

| | | | |
|---|---|---|---|
| 0495475 | 7/1992 | European Pat. Off. | 430/109 |
| 6-59505 | 3/1994 | Japan | 430/109 |

OTHER PUBLICATIONS

English-Language Japio Abstract 04349877 of Japanese Patent 05-341577 (Pub. Dec. 1993).

English language Derwent abstract of JP5-341577 (Pub. Dec. 1993).

English—Abstract of JP 57-109825.

English Abstract of JP 84-011902.

English Abstract of JP 5341557.

English Abstract of JP 5249745.

*Primary Examiner*—Janis L. Dote

*Attorney, Agent, or Firm*—Birch, Stewart, Kolasch & Birch, LLP

[57] ABSTRACT

The toner for full-color electrophotography usable for a fixing process by a heat roller, wherein a releasing oil is not applied on a surface of the heat roller, includes at least (a) a binder resin having as a main component a linear polyester obtainable using one or more monomers selected from the group consisting of saturated or unsaturated, aliphatic dicarboxylic acids, acid anhydrides thereof, and lower alkyl esters thereof as an acid component, provided that the saturated aliphatic dicarboxylic acids have carbon atoms of not less than 3, and that the unsaturated aliphatic dicarboxylic acids have carbon atoms of not less than 5, the linear polyester having a softening point of from 90° to 120° C. determined by "koka" type flow tester; (b) a releasing agent comprising carnauba wax; and (c) a coloring agent. The method for forming fixed images for full-color electrophotography includes the steps of forming an unfixed image by using three or four kinds of toners on a recording medium in single or more toner layers wherein said toners include at least one toner for full-color electrophotography of the present invention; and fixing by heat and pressure the unfixed image using a heat roller without a device for applying a releasing oil.

8 Claims, 1 Drawing Sheet

TONER FOR FULL-COLOR ELECTROPHOTOGRAPHY AND METHOD FOR FORMING FIXED IMAGES USING THE SAME

BACKGROUND OF THE INVENTION

1. Field of the Invention

The present invention relates to a toner used for a full-color electrophotographic system, and a method for forming fixed images using the above toner. More specifically, the present invention relates to a toner for full-color electrophotography usable for developing electrostatic latent images formed in a full-color electrophotographic system, the toner having offset resistance at a sufficient level, and a method for forming fixed images using the above toner.

2. Discussion of the Related Art

Full-color electrophotography may be roughly classified into two types: A single-functional process where each of the functions, such as color separation function, latent image formation function, and inking function, works separately; or a complex-functional process where some parts of the above functions work together. These processes are further classified, and methods for forming full-color fixed images utilizing each of the above processes have been studied. Particularly, since the single-functional process shares much of its art with the monochromatic processes, various studies have conducted thereupon. In general, a monochromatic process comprises the steps of evenly charging a photoconductive insulating layer (a charging process); subsequently exposing the layer to eliminate the charge on the exposed portion, to thereby form an electrostatic latent image (an exposing process); visualizing the formed image by adhering colored charged fine powder, known as a toner, to the latent image (a developing process); transferring the obtained visible image to an image-receiving sheet such as a transfer paper (a transfer process); and permanently fixing the transferred image by heating, pressure application or other appropriate means of fixing (a fixing process). The single-functional process for full-color electrophotography mainly differs from the monochromatic process in the color separation conducted prior to the developing process and the color blending conducted after the transfer process.

The single-functional processes may be further classified into a direct type where fixing is conducted without a transfer process and a transfer type where an electrostatic image is transferred to an image-receiving sheet. The transfer-type processes may be further classified into a three-times transfer method by color xerography and a once transfer method by color-laminating development. In all of these methods, color toners have to be blended upon fixing, and the color blending is carried out by transferring a toner on an image-receiving sheet in a transfer process, and then fixing by fusing the toners by means of heat and pressure using a heat roller, etc.

At the time of blending the color toners, when a poor fusion of the toner takes place, frequency of air gaps between the toner particles become higher, thereby resulting in loss of toning inherent to toner pigments by photoscattering at the interface with air. Also, glossiness of the formed images is lost. Moreover, at the portions where toners overlap with each other, the toner in a lower layer is covered up with the toner in an upper layer, thereby undesirably lowering the color reproducibility.

Therefore, the following requirements have to be met for binder resins used for toner for full-color electrophotography:

(1) Binder resins should have such properties that the fixed toners become in a state near complete fusion without retaining the original shape of the toner particles, so as not to inhibit color reproducibility by preventing irregular reflection against light.

(2) Binder resins should have sufficiently high transparency so as not to block the toning of the lower toner layer having different toning by the upper toner layer.

As mentioned above, the binder resins have to give wide fixing temperature ranges, good transparency of the resin, and a flat image-bearing surface upon fixing. Therefore, besides the wide fixing temperature range and the high offset resistance required for monochromatic processes, additional requirements in the melting property and the transparency have to be met.

As mentioned above, in the toner for full-color electrophotography, the binder resins have to have particularly superior melting property when compared with a monochromatic color toner. On the other hand, the fixing temperature of the toner for full-color electrophotography is set relatively higher than that of the monochromatic process. However, the melting property and the offset resistance are two contradictory properties: As the fixing temperature is set relatively high in a heat-and-pressure fixing using a heat roller, an offset phenomenon is likely to take place, wherein a part of the toner is adhered to the surface of the heat roller, which in turn is transferred to a subsequent transfer paper.

In order to inhibit the above offset phenomenon, in the case of monochromatic processes employing heat-and-pressure fixing using a heat roller, etc., fixing may be generally carried out without applying a releasing oil by incorporating a releasing agent with the toner for inhibiting offset, or using a material with an excellent releasing property for a heat roller surface material. However, in a full-color electrophotographic system where excellent melting property of the toner is highly demanded as mentioned above, no other methods have yet been known other than the ones in which a releasing oil is applied on a heat roller surface. Therefore, in conventional systems, a device for applying oil has to be included in order to obtain high glossiness at a low temperature, thereby making the costs of the device high, complicating the apparatus, and making the overall apparatus large.

Therefore, in the full-color electrophotographic system, a color toner including no devices for applying a releasing oil in the fixing process is in strong demand in the field of art.

On the other hand, in order to improve the offset resistance of the toner, developments have been made on the binder resins and various offset inhibitors used therefore, but much of the developments, some of which are cited hereinbelow, are adapted only for the monochromatic processes but not readily applicable for full-color toner for practical purposes.

Methods for improving the offset resistance of the toners by using a polyester having a three-dimensional structure with a polycarboxylic acid are disclosed in Japanese Patent Laid-Open No. 57-109825 and Japanese Patent Examined Publication No. 59-11902. In the above methods, however, although the offset resistance can be somewhat improved, since an amount of a crosslinking acid component is large, the toner obtained therefrom has a large elasticity, so that the resulting image-bearing surface is not flat when fixing in a relatively low-temperature region, thereby causing problems in color reproducibility when used for toners for full-color electrophotography.

As an example of using carnauba wax as an offset inhibitor, Japanese Patent Laid-Open No. 5-341577 discloses a toner for electrophotographic development containing a polyester as a binder resin, a free fatty acid-removed type carnauba wax having an acid value of 5 mg/g KOH as a releasing agent (offset inhibitor), and a compound having a particular structure as a charge control agent. In Examples which is set forth hereinbelow, when fixing is carried at 13° C. using a color toner in a plain paper copy machine without a device for applying a releasing oil, no offset phenomena are confirmed to have taken place. At that time, it is found that the melting property of the toner is sufficient for monochromatic processes, but insufficient for full-color processes (shown in Comparative Example 3). In other words, the toner disclosed in this publication is only used for monochromatic processes, but not applicable for a system for full-color electrophotography.

Aside from the above, there are various prior art references using carnauba wax as an offset inhibitor (for instance, Japanese Patent Laid-Open Nos. 5-249745 and 5-142856). However, all of the publications disclose toners used for monochromatic processes, and a toner for electrophotography which can be used for a system for full-color electrophotography without using an oil applying device has not yet been found so far.

SUMMARY OF THE INVENTION

An object of the present invention is to provide a toner for full-color electrophotography usable for a system for full-color electrophotography without a device for applying a releasing oil, the toner for full-color electrophotography having an excellent melting property in the toner, excellent glossiness in the fixed images, and excellent offset resistance.

Another object of the present invention is to provide a method for forming fixed images using the above toner for full-color electrophotography.

As a result of intense research in view of achieving the above objects, the present inventors have found that by using a particular linear polyester as a binder resin and a carnauba wax as a releasing agent, a toner free from the conventional problems can be obtained. Thus, the present invention has been completed.

Specifically, the gist of the present invention is as follows:

(1) A toner for full-color electrophotography usable for a fixing process by a heat roller, wherein a releasing oil is not applied on a surface of the heat roller, the toner comprising at least:

(a) a binder resin comprising as a main component a linear polyester obtainable using one or more monomers selected from the group consisting of saturated or unsaturated, aliphatic dicarboxylic acids, acid anhydrides thereof, and lower alkyl esters thereof as an acid component, provided that the saturated aliphatic dicarboxylic acids have carbon atoms of not less than 3, and that the unsaturated aliphatic dicarboxylic acids have carbon atoms of not less than 5, the linear polyester having a softening point of from 90° to 120° C. determined by "koka" type flow tester;

(b) a releasing agent comprising carnauba wax; and (c) a coloring agent;

(2) The toner for full-color electrophotography described in (1) above, wherein the linear polyester is obtainable using one or more monomers selected from the group consisting of saturated or unsaturated, aliphatic dicarboxylic acids, acid anhydrides thereof, and lower alkyl esters thereof as an acid component in an amount of not less than 25 mol % of an entire acid component, the saturated or unsaturated, aliphatic dicarboxylic acid having a main chain with 3 to 30 carbon atoms, or having a main chain and a side chain with 3 to 30 total carbon atoms;

(3) The toner for full-color electrophotography described in (1) or (2) above, wherein the aliphatic dicarboxylic acid is selected from the group consisting of succinic acid, adipic acid, sebacic acid, and azelaic acid;

(4) The toner for full-color electrophotography described in any one of (1) to (3) above, wherein the linear polyester has a glass transition temperature of not less than 45° C.;

(5) The toner for full-color electrophotography described in any one of (1) to (4) above, wherein the linear polyester has a weight-average molecular weight determined by gel permeation chromatography of from 8,000 to 30,000;

(6) The toner for full-color electrophotography described in any one of (1) to (5) above, wherein the linear polyester has an acid value of not more than 40 KOH mg/g and a hydroxyl value of not more than 40 KOH mg/g;

(7) The toner for full-color electrophotography described in any one of (1) or (6) above, wherein the binder resin further comprises a non-linear polyester having a crosslinked structure in an amount of from 5 to 25% by weight of the binder resin, the non-linear polyester having a side chain with 2 to 30 carbon atoms;

(8) The toner for full-color electrophotography described in any one of (1) to (7) above, wherein the content of the carnauba wax is 4 to 15 parts by weight, based on 100 parts by weight of the binder resin; and (9) A method for forming fixed images for full-color electrophotography, comprising the steps of:

forming an unfixed image by using three or four kinds of toners on a recording medium in single or more toner layers, colors of the toners being primary colors or primary colors and black color, wherein the toners include at least one toner for full-color electrophotography described in any one of (1) to (8) above; and fixing by heat and pressure the unfixed image using a heat roller without a device for applying a releasing oil.

BRIEF DESCRIPTION OF THE DRAWING

The present invention will become more fully understood from the detailed description given hereinbelow and the accompanying drawing which is given by way of illustration only, and thus, is not limitative of the present invention, and wherein.

Figure 1:
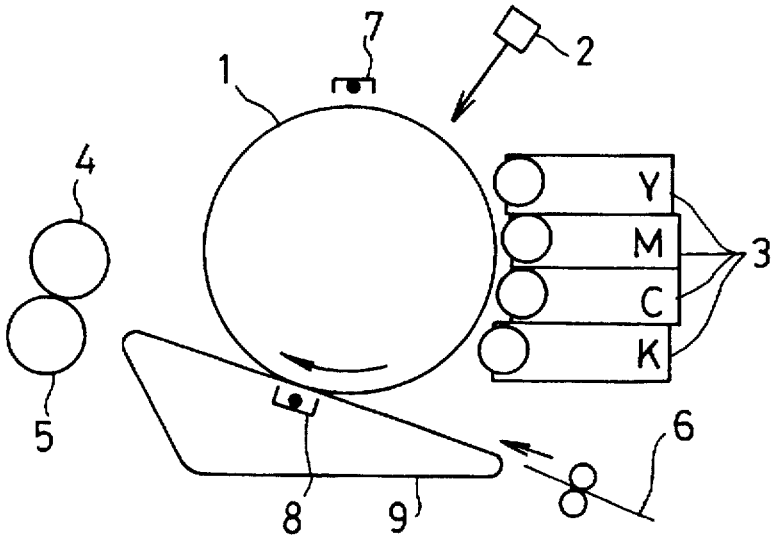
FIG. 1 is a schematic view showing one example of an apparatus used for the method for forming fixed images of the present invention.

Each of the reference numerals in FIG. 1 is as follows:

1 denotes a photoconductor, 2 an exposure device, 3 a developer device, 4 a heat roller, 5 a pressure roller, 6 a recording medium, 7 a charger, 8 a transfer device, and 9 a conveyor belt.

DETAILED DESCRIPTION OF THE INVENTION

The toner for full-color electrophotography of the present invention is usable for a fixing process by a heat roller, wherein a releasing oil is not applied on a surface of the heat roller, the toner comprising at least:

(a) a binder resin comprising as a main component a linear polyester obtainable using one or more monomers selected from the group consisting of saturated or unsaturated, aliphatic dicarboxylic acids, acid anhydrides thereof, and lower alkyl esters thereof as an acid component, provided that the saturated aliphatic dicarboxylic acids have carbon atoms of not less than 3, and that the unsaturated aliphatic dicarboxylic acids have carbon atoms of not less than 5, the linear polyester having a softening point of from 90° to 120° C. determined by "koka" type flow tester;

(b) a releasing agent comprising carnauba wax; and (c) a coloring agent.

First, the binder resin usable in the present invention will be explained below.

The binder resin comprises as a main component a linear polyester having a softening point determined by "koka" type flow tester of from 90° to 120° C., preferably of from 90° to 110° C., more preferably of from 95° to 105° C. When the softening point is lower than 90° C., the storage stability of the resulting toner is poor, and for instance, when the toner is kept standing in the environmental conditions of a storage temperature of 45° C. and 60% humidity for two weeks, the toner is lumped into a block form, showing an agglomeration determined by powder tester of about 50%, thereby having much difficulty in practical use. Further, during the fixing process, a so-called "cold offset" takes place, wherein only the toner on a top layer transferred to a paper is melted and transferred to a fixing roller surface. On the contrary, when the softening point exceeds 120° C., the melting property of the toner becomes poor, thereby making the low-temperature fixing ability of the toner poor, leading to a low glossiness in the formed fixed images. In addition, the insufficient coloring gives a fading color to the resulting fixed images, and OHP transparency becomes poor.

The "koka" type flow tester used herein is a device capable of measuring melting behavior of resins at each temperature with a high reproducibility, which is highly effective for the evaluation for the binder resin for toners. The "koka" type flow tester is outlined in JIS K 7210, and in the present invention, the measurement is specifically conducted as given below. Here, a measurement is taken by using a flow tester of the "koka" type manufactured by Shimadzu Corporation in which a $1cm^3$ sample is extruded through a nozzle having a dice pore size of 1 mm and a length of 1 mm, while heating the sample so as to raise the temperature at a rate of 6° C./min and applying a load of 30 $kg/cm^2$ thereto with the plunger. A curve showing the relationship between the downward movement of a plunger (flow length) and temperature is produced from the above measurements. The "softening point" used herein refers to the temperature corresponding to one-half of the height (h) of the S-shaped curve.

The linear polyester used as a main component of the binder resin in the present invention is a polyester having such a structure that its constituting monomers are linear dicarboxylic acids and/or dicarboxylic acids having a side chain with no functional groups. In certain cases, a non-linear polyester having a three-dimensional, crosslinked structure, wherein its constituting monomers contain trivalent or higher polyvalent monomers and other kinds of crosslinking agents, may be blended together with the above linear polyester.

As mentioned above, in the present invention, the reasons why the linear polyester is used as a main component of the binder resin are as follows. When the crosslinking density is increased too much using trivalent or higher valent monomers, etc. as crosslinking components, the elasticity of the obtained polyester becomes large, and the melting speed of the toner becomes lower, thereby making the smoothness and the glossiness of the resulting image-bearing surface poor. On the other hand, the crosslinked, non-linear polyester has excellent hot offset inhibiting effect in the high-temperature region. Therefore, by blending a suitable amount of the non-linear polyester with the linear polyester, the lowering of the melting speed can be inhibited without practically impairing the smoothness and the glossiness of the image-bearing surface.

Among the monomers constituting the linear polyester in the present invention, examples of alcohol components include diols, such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, and 1,6-hexanediol; bisphenol A, hydrogenated bisphenol A, alkylene oxide adducts of bisphenol A, such as polyoxyethylene bisphenol A, and polyoxypropylene bisphenol A, and other dihydric alcohols. Among them, a preference is given to ethylene glycol, polyoxyethylene bisphenol A, and polyoxypropylene bisphenol A.

On the other hand, as for acid components, saturated aliphatic dicarboxylic acids having not less than 3 carbon atoms, or unsaturated aliphatic dicarboxylic acids having not less than 5 carbon atoms, and/or acid anhydrides thereof or lower alkyl esters thereof are used. Examples of the saturated aliphatic dicarboxylic acids having not less than 3 carbon atoms include succinic acid, adipic acid, sebacic acid, azelaic acid, malonic acid, and alkylsuccinic acids, such as n-dodecylsuccinic acid, and acid anhydrides thereof or lower alkyl esters thereof (alkyls having 1 to 5 carbon atoms) may be also used. Among them, a preference is given to succinic acid, adipic acid, sebacic acid, and azelaic acid. Examples of the unsaturated aliphatic dicarboxylic acids having not less than 5 carbon atoms include citraconic acid, itaconic acid, glutaconic acid, and alkenylsuccinic acids, such as n-dodecenylsuccinic acid, and acid anhydrides thereof or lower alkyl esters thereof (alkyls having 1 to 5 carbon atoms) may be also used. In addition to the above essential components, one or more acid components selected from the group consisting of unsaturated aliphatic dicarboxylic acids having a relatively small number of carbon atoms, such as maleic acid and fumaric acid; aromatic dicarboxylic acids, such as phthalic acid, isophthalic acid, and terephthalic acid; alicyclic dicarboxylic acids, such as cyclohexanedicarboxylic acid; acid anhydrides thereof; and lower alkyl esters thereof (alkyls having 1 to 5 carbon atoms) may be added as an acid component. In order to obtain the effects of the present invention, the amount of the saturated or unsaturated, aliphatic dicarboxylic acids (provided that the saturated aliphatic dicarboxylic acids have not less than 3 carbon atoms and the unsaturated aliphatic dicarboxylic acids have not less than 5 carbon atoms, and/or acid anhydrides thereof or lower alkyl esters thereof (alkyls having 1 to 5 carbon atoms) is from 5 to 90 mol %.

The linear polyester in the present invention is obtainable preferably using upon polymerization one or more monomers selected from the group consisting of saturated or unsaturated, aliphatic dicarboxylic acids, acid anhydrides thereof, and lower alkyl esters thereof as an acid component in an amount of not less than 25 mol % of the entire acid component, the saturated or unsaturated, aliphatic dicarboxylic acids each having a main chain with 3 to 30 carbon atoms, particularly with 3 to 12 carbon atoms, or having a main chain and a side chain with 3 to 30 total carbon atoms, particularly with 3 to 20 total carbon atoms. A more preferred amount of the above acid component is from 50 to 100 mol %. When the amount of the above acid component is lower than 25 mol %, the obtained resin becomes brittle, and the resulting toner is likely to have undesirably poor melting property and poor fixing ability.

The reasons why the saturated or unsaturated, aliphatic dicarboxylic acids, etc. are usable as an effective ingredient for an acid component of the linear polyester in the present invention are as follows. When flexible segments are contained in large amounts in a resin, since the resulting polyester has a number-average molecular weight (Mn) larger than those obtainable by using aromatic dicarboxylic acids as acid components, a tough resin, namely a resin having a large pulverization index, can be obtained while maintaining a low softening point and a good melting property.

The linear polyester in the present invention can be polymerized by esterification or transesterification of the above monomers by known methods. Specifically, a condensation polymerization, etc. are carried out, for instance, at a reaction temperature of from 170° to 220° C., a pressure of 5 mmHg to a normal pressure in the presence of a suitable catalyst, optimum temperature and pressure being determined by the reactivity of the monomers, and the reaction may be terminated after reaching given properties.

Although the binder resin in the present invention comprises the linear polyester mentioned above as a main component, other resins, such as non-linear polyesters and styrene-acrylic resins, may be used in combination with the linear polyester in an amount so as not to impair the effects of the present invention.

In the present invention, as other components for the binder resin, the non-linear polyester having a crosslinked structure having a side chain with 2 to 30 carbon atoms are preferably contained in the binder resin, in an amount of from 5 to 25% by weight, particularly from 10 to 20% by weight. By blending the non-linear polyester into the binder resin, the resulting toner is less likely to show hot offsetting as mentioned above, but exceeding amounts of the non-linear polyester lead to poor glossiness in the resulting formed image upon fixing. In other words, when the linear polyester and the non-linear polyester are blended, the difference in their softening points generally affect the glossiness in the resulting formed image. Even if the resulting toners have the same softening point, when the difference in the softening points in the linear polyester and the non-linear polyester is not less than 40° C., the glossiness of the formed images upon fixing is drastically lowered. The difference in the softening points is preferably not more than 30° C., more preferably not more than 20° C., further preferably not more than 10° C. The non-linear polyester having a side chain with 2 to 30 carbon atoms is used in order to increase the glossiness of the formed images upon fixing by adjusting the softening points as mentioned above.

For instance, when the non-linear polyester and the linear polyester are blended, the proportion of the linear polyester in the entire polyester component is preferably from 80 to 90% by weight, and the difference in the softening points is optimally 10° C.

The above non-linear polyester is normally obtainable by using trivalent or higher polyvalent monomers in addition to the divalent monomers set forth above, in which at least one of the above monomers has a side chain with 2 to 30 carbon atoms. Examples of the trivalent or higher polyvalent monomers include tricarboxylic acids or derivatives thereof, such as trimellitic acid anhydride and 2,5,7-naphthalenetricarboxylic acid; and trihydric alcohols, such as glycerol and trimethylolpropane. In addition, examples of the monomers having a side chain with 2 to 30 carbon atoms include dodecenylsuccinic acid anhydride.

The linear polyester in the present invention preferably has a glass transition temperature (Tg) of not less than 450, more preferably not less than 50° C., from the viewpoint of storage stability, etc.

The linear polyester in the present invention preferably has a weight-average molecular weight determined by gel permeation chromatography (hereinafter simply referred to as "GPC") of from 8,000 to 30,000, from the viewpoint of transparency and storage stability.

The linear polyester in the present invention preferably has an acid value of not more than 40 KOH mg/g, more preferably not more than 25 KOH mg/g, and a hydroxyl value of not more than 40 KOH mg/g, more preferably not more than 25 KOH mg/g. When the acid value and the hydroxyl value exceed the above values, the toner is likely to be environmentally affected under high-temperature, high-humidity conditions and low-temperature, low-humidity conditions, thereby making it impossible to obtain good formed images.

Incidentally, the acid values and the hydroxyl values of the polyester resins in the present invention are measured by a method according to JIS K 0070.

Next, the releasing agent used in the present invention will be explained below.

In the present invention, carnauba wax having a melting point lower than the softening point of the above binder resin by a temperature exceeding a given difference, depending upon the type of the binder resins used, is used as a releasing agent for inhibiting offset. Here, the given difference in temperature is usually 10° to 20° C. In Examples of the present invention, the softening point of the binder resin is about 100° C., and the melting point of carnauba wax is about 83° C.

In addition, the content of the carnauba wax is preferably 4 to 15 parts by weight, more preferably 5 to 11 parts by weight, based on 100 parts by weight of the above binder resin. When the content of the carnauba wax is less than 4 parts by weight, the non-offset region becomes notably narrow, thereby making it impossible to fix without a releasing oil at a high temperature side. On the contrary, when the content exceeds 15 parts by weight, the storage stability, the pulverizability, and the kneading property of the resulting toner become poor.

As mentioned above, when the above linear polyester and the carnauba wax are used in combination, since the carnauba wax bleed out from the toner before melting of the resin takes place, a wide non-offset region can be enjoyed even when fixing without a releasing oil, namely an "oil-free environment."

The toner of the present invention contains the binder resin and the releasing agent mentioned above, and it may further contain a charge control agent, and if necessary, a fluidity improver, in addition to an essential component, a coloring agent.

The coloring agents usable in the present invention may be known organic pigments and dyes, which may be also used in combination. The coloring agents are normally those having colors corresponding to respective three primary color toners, such as yellow toners, magenta toners, and cyan toners. Incidentally, the coloring agents are listed below, without intending to limit the coloring agents in the present invention to these organic pigments and dyes.

As for yellow toners, C.I. Pigment Yellow 12, C.I. Pigment Yellow 14, C.I. Solvent Yellow 30, and C.I. Solvent Yellow 77 may be used singly or in combination.

As for magenta toners, C.I. Pigment Red 122, C.I. Pigment Red 48:2, C.I. Pigment Red 58:2, C.I. Solvent Red 49, and C.I. Solvent Red 52 may be used singly or in combination.

As for cyan toners, C.I. Pigment Blue 15:3, C.I. Pigment Blue 15:4, C.I. Pigment Blue 15:1, C.I. Solvent Blue 69, and C.I. Solvent Blue 23 may be used singly or in combination.

In addition, in the case where a black toner is prepared in the present invention, any of the known ones can be used, including various carbon blacks obtainable by a thermal black method, an acetylene black method, a channel black method, or a lamp black method; and grafted carbon black obtainable by coating the surface of carbon black with a resin.

Further, for the purpose of matching the developing mechanism and of improving formed images, particulate magnetic materials may be incorporated in the toner. Examples of the particulate magnetic materials include alloys or compounds containing an element having ferromagnetic properties, such as ferrite and magnetite. The particulate magnetic materials in a form of fine particulate having an average particle size of from 0.05 to 1.00 μm are dispersed in a thermoplastic resin in an amount of from 0.05 to 10.00% by weight.

Also, the usable positive charge control agents are not limited, ranging from low molecular compounds to high molecular compounds, including polymers. Examples thereof include nigrosine dyes such as "NIGROSINE BASE EX" (manufactured by Orient Chemical Co., Ltd.), "OIL BLACK BS" (manufactured by Orient Chemical Co., Ltd.), "OIL BLACK SO" (manufactured by Orient Chemical Co., Ltd.); triphenylmethane dyes; quaternary ammonium salt compounds; and vinyl polymers having one or more amino groups.

In addition, examples of the usable negative charge control agents include metal complex salts of monoazo dyes; nitrohumic acid and salts thereof; compounds having one or more nitro groups or halogen elements; sulfonated copper phthalocyanine; and maleic acid anhydride copolymers.

The toner of the present invention may further include various known property modifiers such as fluidity improvers, and thermal property improvers such as metal complexes including chromium complexes of 3,5-di-tert-butylsalicylic acid and metal oxides such as zinc oxide. The property modifiers may be used in suitable amounts so as not to inhibit the effects of the present invention.

The toner of the present invention may be produced by any of conventionally known production methods such as a kneading and pulverization method, a spray-drying method, and a polymerization method. For instance, the toner of the present invention may be generally produced by steps of uniformly dispersing and mixing a binder resin, a releasing agent, a coloring agent, a charge control agent, and the like in a known mixer such as a ball-mill, melt-blending the obtained mixture in a sealed kneader or a single-screw or twin-screw extruder, cooling the extruded mixture, pulverizing the cooled mixture, and classifying the pulverized mixture. In addition, additives such as fluidity improvers may be optionally added to the toner.

The obtained product is a colored powder having an average particle size of 5 to 15 μm, namely the toner of the present invention, which may be used without further treatment as a one-component developer. Alternatively, in the case of producing a dry-type two-component developer composition, the above toner may be blended for a suitable period of time with a carrier, the carrier being a magnetic powder having irregular or spherical shape and comprising a core made of iron powder, ferrite, magnetite, or a resin and a coating comprising a silicone resin, an acrylic resin, or a polyester resin, the coating formed on the surface of the core, to give a developer composition.

The toner for full-color electrophotography of the present invention does not require an application of a releasing oil upon fixing, and the toner has a wide non-offset region of normally about 80° C. and capable of obtaining highly glossy images by carrying out fixing at a relatively low temperature of about 150 ° C.

Specifically, the glossiness was evaluated by measuring at degree of glossiness at conditions of 60°/60° using "VG-2PD" (manufactured by Nippon Denshoku Kogyo Kabushiki Kaisha), and a degree of glossiness of not less than 15 is found in the solid image portion having toner adhesion content of 0.7 mg/cm$^2$ in the formed images.

The method for forming fixed images in the present invention for full-color electrophotography comprises the steps of forming an unfixed image by using three or four kinds of toners on a recording medium in single or more toner layers, colors of the toners being primary colors or primary colors and black color, wherein said toners include at least one toner for full-color electrophotography of the present invention described above; and fixing by heat and pressure the unfixed image using a heat roller without a device for applying a releasing oil.

Here, the methods for forming fixed images may be any known methods as long as they employ a method comprising transferring a toner to an image-receiving sheet in a transfer process, and then fixing by heat and pressure using a heat roller to thereby melt the toner and blend the colors. Specifically, any methods utilizing a single-functional type system for full-color electrophotography where each of the functions, such as color separation, latent image formation, and inking, works separately. A three-times transfer method by color xerography and a once transfer method by color-laminating development may be used as long as transferring is carried out using an image-receiving sheet.

FIG. 1 is a schematic view showing one example of an apparatus used for the method for forming fixed images of the present invention. This apparatus employs for multi-laminar development by color xerography, without intending to limit the method of the present invention thereto.

The construction of the apparatus will be explained hereinbelow referring to the drawing.

In the process for color xerography, the method employed is basically similar to that for monochromatic process in that the method comprises the steps of charging photoconductive insulating layer (a charging process); subsequently exposing the layer to eliminate the charge on the exposed portion, to thereby form an electrostatic latent image formed on a photoconductor (an exposing process); visualizing the formed image by adhering colored charged fine powder, known as a toner, to the latent image (a developing process); transferring the obtained visible image to a recording medium such as a recording paper (a transfer process); and fixing the transferred image to the recording medium (a fixing process). The process for color xerography is mainly different from that from the monochromatic process in the additional steps of carrying out such steps as color separation before the exposing process, forming multi-layered visible images in the developing process, and blending colors upon the fixing process.

In the FIG. 1 denotes a photoconductor, and those of selenium-based, silicon-based, organo-based, etc., are generally in practical use, any of which can be used in the present invention.

7 denotes a charger arranged opposite to the photoconductor 1. The charging means is not particularly limited, and for instance, a corona charger, a brush charger, a roller charger, etc. can be used.

2 denotes an exposure device arranged opposite to the photoconductor 1 for forming electrostatic latent images on the photoconductor surface. For an exposure device 2, light sources such as laser beams, LED or EL arrays, etc. are used in combination with an image-forming optical system. Alternatively, a device based on optical systems capable of projecting a photo image formed by color-separating a color document using a color separation filter can be used. In either method, exposure according to the color component of each toner is carried out.

3 denotes a plurality of developer devices arranged opposite to the photoconductor 1 for making visible the electrostatic latent image formed on the photoconductor with the toner, each of the developer devices is arranged according to each color of the toner. For developer devices, any of the commonly used two-component magnetic brush developer device, the one-component magnetic brush developer device, the one-component nonmagnetic developer device, etc. can be used.

The visible image formed on the photoconductor 1 in the developing process is conveyed along the rotation of the photoconductor rotating at a constant peripheral speed in the direction shown in FIG. 1 by a specified driving means not illustrated in the figure. In this apparatus, since the visible images are formed into multi-layers, the above processes from the charging process to the developing process are repetitively conducted for a number of times depending upon the kinds of toners used.

The visible image formed by the above processes is conveyed to a transfer portion, and the visible image is transferred to a recording medium 6, the recording medium being conveyed by a conveyor belt 9 arranged so as to synchronize with the initial end of the visible image. The transfer is carried out by static transfer, such as corona transfer and bias roller transfer using a transfer device 8, to thereby form an unfixed image composed of single-layered or multi-layered toners.

The fixing portion comprises a heat roller 4 and a pressure roller 5. The heat roller 4 is coated with a heat-resistant resin, such as silicone rubbers, fluroresins, polyimide resins, polyamide resins, and polyamide-imide resins, and the heat roller has contains a heat source in an inner portion thereof. The pressure roller 5 is made of a heat-resistant silicone rubber.

In the present invention, after forming the unfixed images, the heat-and-pressure fixing can be conducted without using a device for applying a releasing oil.

After the transfer process, in order to remove small amounts of the toner remaining on the surface of the photoconductor, a cleaner device, such as a cleaning web, may be arranged in the apparatus. Also, in order to neutralize the charges remaining on the photoconductor, a charge eraser, such as a charge erasing lamp, may be arranged in the apparatus.

Also, after the toner is fixed on the recording medium 6, the recording medium is discharged from the apparatus by a given discharging means.

The toner for full-color electrophotography of the present invention has a good melting property, thereby giving excellent glossiness in the resulting formed fixed images, and has a good offset resistance, thereby making it highly suitably for a system for full-color electrophotography. Therefore, the method for forming fixed images of the present invention using the above toner does not require an application of a releasing oil, thereby making it possible to simplify and miniaturize the overall apparatus and lower the apparatus cost.

EXAMPLES

The present invention will be explained in further detail by means of the following Production Examples, Examples, and Comparative Examples, without intending to restrict the scope of the present invention thereto. The glass transition temperature (Tg) and the molecular weight determined by GPC of the obtained resin in each of Examples and Comparative Examples were evaluated as follows.

Glass Transition Temperature (Tg)

The glass transition temperature (Tg) was referred to the temperature of an intersection of the extension of the baseline of not more than the glass transition temperature and the tangential line showing the maximum inclination between the kickoff of the peak and the top thereof as determined with a sample using a differential scanning calorimeter ("DSC Model 200," manufactured by Seiko Instruments, Inc.), at a heating rate of 10° C./min. The sample was treated before measurement using the DSC by raising its temperature to 100° C., keeping at 100° C. for 3 minutes, and cooling the hot sample at a cooling rate of 10° C./min. to room temperature.

Molecular Weight Determination by Gel Permeation Chromatography (GPC)

The molecular weight of the obtained binder resin was measured by maintaining the temperature of a column in a thermostat set at 40° C. and injecting 100 μl of a chloroform solution of the sample, which was adjusted to have a sample concentration of 0.05 to 0.5% by weight, while flowing chloroform at a flow rate of 1 ml per minute as an eluent. The molecular weight of the sample was calculated by the molecular weight distribution determined from the retention time of the sample and a calibration curve prepared in advance. Here, the calibration curve was prepared from several kinds of monodisperse polystyrenes used as standard samples.

Column used in analysis: GMHL+G3000 HXL (manufactured by Tosoh Corporation)

Resin Production Example 1
[Resin A: Linear Polyester]

| | |
|---|---|
| Polyoxypropylene(2.2)-2,2-bis(4-hydroxyphenyl) propane | 1050 g |
| Fumaric acid | 520 g |
| Hydroquinone (Polymerization inhibitor) | 1 g |

The above materials having a fumaric acid content of 100 mol % in the entire acid component were placed into a three-liter four-necked glass flask together with a generally used esterification catalyst (dibutyltin oxide). A thermometer, a stainless steel stirring rod, a reflux condenser, and a nitrogen inlet tube were attached to the above flask, and the contents were heated while stirring in a mantle heater under a nitrogen stream under the conditions of 230° C. and normal pressure for the first-half of the reaction, and 200° C. and reduced pressure for the second-half of the reaction.

The resulting linear polyester resin had an acid value of 10.1 KOH mg/g, a hydroxyl value of 8.6 KOH mg/g, a softening point determined by koka-type flow tester of 112.8° C., a glass transition temperature of 66.1° C., and a weight-average molecular weight determined by GPC of 30,000.

| Resin Production Example 2 [Resin B: Non-Linear Polyester Containing Side Chain of Soft Segment Monomer] | |
|---|---|
| Polyoxypropylene(2.2)-2,2-bis(4-hydroxyphenyl ) propane | 460 g |
| Polyoxyethylene(2.2)-2,2-bis(4-hydroxyphenyl)propane | 425 g |
| Trimellitic acid anhydride | 48 g |
| Terephthalic acid | 165 g |
| Dimethylterephthalic acid | 49 g |
| Dodecenylsuccinic acid anhydride | 268 g |
| Dibutyltin oxide | 1 g |

The above materials having a dodecenylsuccinic acid anhydride content of 40 mol % in the entire acid component were used, and the reaction was proceeded by a similar method to in Resin Production Example 1 using a similar apparatus to that above.

The resulting non-linear polyester resin had an acid value of 20.4 KOH mg/g, a hydroxyl value of 31.5 KOH mg/g, a softening point determined by koka-type flow tester of 102.8° C., a glass transition temperature of 57.8° C., and a weight-average molecular weight determined by -GPC of 25,000.

| Resin Production Example 3 [Resin C: Polyester Containing Main Chain of Soft Segment Monomer] | |
|---|---|
| Polyoxypropylene(2.2)-2,2-bis(4-hydroxyphenyl)propane | 999 g |
| Polyoxyethylene(2.2)-2,2-bis(4-hydroxyphenyl)propane | 48 g |
| Fumaric acid | 156 g |
| Terephthalic acid | 126 g |
| Adipic acid | 153 g |
| Dibutyltin oxide | 1 g |

The above materials having a total content of fumaric acid and adipic acid of 80 mol % in the entire acid component were used, and the reaction was proceeded by a similar method to in Resin Production Example 1 using a similar apparatus to that above.

The resulting linear polyester resin had an acid value of 15.8 KOH mg/g, a hydroxyl value of 12.2 KOH mg/g, a softening point determined by koka-type flow tester of 104.9° C., a glass transition temperature of 55.8° C., and a weight-average molecular weight determined by GPC of 15,000.

Toner Production Example 1

(1) Yellow Toner 1

Four parts by weight of carnauba wax (melting point: 83° C.), 3 parts by weight of a benzidine-based yellow pigment, and 0.5 parts by weight of a charge control agent ("LR-147," manufactured by Nippon Carlit), based on 100 parts by weight of Resin A, were added and kneaded in a twin-screw extruder. After cooling the kneaded mixture, the mixture was subject to conventional pulverization and classification, to give a fine powder having an average particle size of 7 μm. The above fine powder was surface-treated with silica ("TS-530," manufactured by Cabot Corporation), to give Yellow Toner 1.

(2) Magenta Toner 1

The procedures similar to those of (1) above up to the surface-treatment step using silica were carried out except for using 6 parts by weight of a quinacridone pigment in place of 3 parts by weight of the benzidine-based yellow pigment, to give Magenta Toner 1 having an average particle size of 7 μm.

(3) Cyan Toner 1

The procedures similar to those of (1) above up to the surface-treatment step using silica were carried out except for using 3 parts by weight of a copper phthalocyanine cyan pigment in place of 3 parts by weight of the benzidine-based yellow pigment, to give Cyan Toner 1 having an average particle size of 7 μm.

Toner Production Example 2

(1) Yellow Toner 2

Four parts by weight of a polypropylene wax (melting point: 130° C.), 3 parts by weight of a benzidine-based yellow pigment, and 0.5 parts by weight of a charge control agent ("LR-147," manufactured by Nippon Carlit), based on 100 parts by weight of Resin A, were added and kneaded in a twin-screw extruder. After cooling the kneaded mixture, the mixture was subject to conventional pulverization and classification, to give a fine powder having an average particle size of 7 μm. The above fine powder was surface-treated with silica ("TS-530," manufactured by Cabot Corporation), to give Yellow Toner 2.

(2) Magenta Toner 2

The procedures similar to those of (1) above of Toner Production Example 2 up to the surface-treatment step using silica were carried out except for using 6 parts by weight of a quinacridone pigment in place of 3 parts by weight of the benzidine-based yellow pigment, to give Magenta Toner 2 having an average particle size of 7 μm.

(3) Cyan Toner 2

The procedures similar to those of (1) above of Toner Production Example 2 up to the surface-treatment step using silica were carried out except for using 3 parts by weight of a copper phthalocyanine cyan pigment in place of 3 parts by weight of the benzidine-based yellow pigment, to give Cyan Toner 2 having an average particle size of 7 μm.

Toner Production Example 3

(1) Yellow Toner 3

Ten parts by weight of carnauba wax (melting point: 83° C.), 3 parts by weight of a benzidine-based yellow pigment, and 0.5 parts by weight of a charge control agent ("LR-147," manufactured by Nippon Carlit), based on 100 parts by weight of a mixed resin comprising 16 parts by weight of Resin B and 84 parts by weight of Resin C, were added and kneaded in a twin-screw extruder. After cooling the kneaded mixture, the mixture was subject to conventional pulverization and classification, to give a fine powder having an average particle size of 7 μm. The above fine powder was surface-treated with silica ("TS-530," manufactured by Cabot Corporation), to give Yellow Toner 3.

(2) Magenta Toner 3

The procedures similar to those of (1) above of Toner Production Example 3 up to the surface-treatment step using silica were carried out except for using 6 parts by weight of a quinacridone pigment in place of 3 parts by weight of the benzidine-based yellow pigment, to give Magenta Toner 3 having an average particle size of 7 μm.

(3) Cyan Toner 3

The procedures similar to those of (1) above of Toner Production Example 3 up to the surface-treatment step using silica were carried out except for using 3 parts by weight of a copper phthalocyanine cyan pigment in place of 3 parts by weight of the benzidine-based yellow pigment, to give Cyan Toner 3 having an average particle size of 7 μm.

Toner Production Example 4

(1) Yellow Toner 4

Ten parts by weight of carnauba wax (melting point: 83° C.), 3 parts by weight of a benzidine-based yellow pigment, and 0.5 parts by weight of a charge control agent ("LR-147," manufactured by Nippon Carlit), based on 100 parts by weight of Resin A, were added and kneaded in a twin-screw extruder. After cooling the kneaded mixture, the mixture was subject to conventional pulverization and classification, to give a fine powder having an average particle size of 7 μm. The above fine powder was surface-treated with silica ("TS-530," manufactured by Cabot Corporation), to give Yellow Toner 4.

(2) Magenta Toner 4

The procedures similar to those of (1) above of Toner Production Example 4 up to the surface-treatment step using silica were carried out except for using 6 parts by weight of a quinacridone pigment in place of 3 parts by weight of the benzidine-based yellow pigment, to give Magenta Toner 4 having an average particle size of 7 μm.

(3) Cyan Toner 4

The procedures similar to those of (1) above of Toner Production Example 4 up to the surface-treatment step using silica were carried out except for using 3 parts by weight of a copper phthalocyanine cyan pigment in place of 3 parts by weight of the benzidine-based yellow pigment, to give Cyan Toner 4 having an average particle size of 7 μm.

Toner Production Example 5

(1) Yellow Toner 5

Ten parts by weight of carnauba wax (melting point: 83° C.), 3 parts by weight of a benzidine-based yellow pigment, and 0.5 parts by weight of a charge control agent ("LR-147," manufactured by Nippon Carlit), based on 100 parts by weight of a mixed resin comprising 30 parts by weight of Resin B and 70 parts by weight of Resin C, were added and kneaded in a twin-screw extruder. After cooling the kneaded mixture, the mixture was subject to conventional pulverization and classification, to give a fine powder having an average particle size of 7 μm. The above fine powder was surface-treated with silica ("TS-530," manufactured by Cabot Corporation), to give Yellow Toner 5.

(2) Magenta Toner 5

The procedures similar to those of (1) above of Toner Production Example 5 up to the surface-treatment step using silica were carried out except for using 6 parts by weight of a quinacridone pigment in place of 3 parts by weight of the benzidine-based yellow pigment, to give Magenta Toner 5 having an average particle size of 7 μm.

(3) Cyan Toner 5

The procedures similar to those of (1) above of Toner Production Example 5 up to the surface-treatment step using silica were carried out except for using 3 parts by weight of a copper phthalocyanine cyan pigment in place of 3 parts by weight of the benzidine-based yellow pigment, to give Cyan Toner 5 having an average particle size of 7 μm.

Apparatus Used for Fixing Test

The development was carried using a transfer drum-type laser printer, in which the fixing device was removed from the apparatus. A monochromatic image formed was taken out in an unfixed state and then fixed with an external fixing device. Here, the "external fixing device" was referred to a device taken out to singly function for fixing. In this example, the external fixing device comprised a pair of upper and lower rollers made of soft silicone, where the upper top roller is a heat roller having a diameter of 40 mm.

Fixing Test 1

In Fixing Test 1, A4 plain white sheets in a 100 sheets-batch were passed through a brand new heat roller arranged in the external fixing device for removing the releasing oil on the roller, to thereby determine whether or not the formed images are fixable with respect to the number of sheets. The formed images were fixed at conditions of a fixing temperature of a heat roller surface of 150° C. and a linear speed of 100 mm/sec. The fixing was carried out in a completely oil-free state. Incidentally, it was confirmed in advance that substantially all of the oil components remaining on the roller were able to be removed to such an extent that the oil components do not give mal-affects to the testing after passing 700 to 1000 A4 plain white papers.

Fixing Test 2

In Fixing Test 2, 700 to 1000 A4 plain white sheets were passed through a brand new heat roller arranged in the external fixing device to remove the oil components remaining on the roller. Then, the unfixed images were fixed at a fixing temperature of a heat roller surface of from 100° to 200° C., to determine the non-offset temperature range. The formed images were fixed at a linear speed of 100 mm/sec.

EXAMPLE 1

Magenta Toner 3 prepared above was subjected to Fixing Tests 1 and 2. As a result of Fixing Test 1, by employing Magenta Toner 3 which was a blend of Resin B, a non-linear polyester containing a side chain of soft segment monomer, and Resin C, a polyester containing a main chain of soft segment monomer, clear images were fixable even after passing not less than 2000 plain white papers. In addition, as a result of Fixing Test 2, Magenta Toner 3 had a non-offset temperature region of from 120° to 200° C. Also, when the images were fixed at a temperature of 150° C., the solid image portions had a high glossiness with a degree of glossiness of not less than 20 when a found angle of incidence was 60°/60° and an amount of toner adhered was from 0.7 to 0.8 mg/cm$^2$.

Comparative Example 1

Magenta Toner 1 prepared above was subjected to Fixing Tests 1 and 2. As a result of Fixing Test 1, by employing Magenta Toner 1 where carnauba wax was used, clear images were fixable even after passing not less than 1500 plain white papers. In addition, as a result of Fixing Test 2, Magenta Toner 1 had a non-offset temperature region of from 120° to 160° C., so that the temperature region was too narrow for practical purposes.

Comparative Example 2

Magenta Toner 4 prepared above was subjected to Fixing Tests 1 and 2. As a result of Fixing Test 1, in Magenta Toner 4 where carnauba wax was used, clear images were fixable even after passing not less than 1500 plain white papers. In addition, as a result of Fixing Test 2, Magenta Toner 4 had a non-offset temperature region of from 120° to 180° C., so that the temperature region was too narrow for practical purposes.

Comparative Example 3

Magenta Toner 2 prepared above was subjected to Fixing Tests 1 and 2. As a result of Fixing Test 1, in Magenta Toner 2 where polypropylene wax was used, clear images were unable to be fixed after passing 700 plain white papers, whereas clear images were fixable after passing 1500 plain white papers for Magenta Toner 1 in Comparative Example 1. In addition, as a result of Fixing Test 2, Magenta Toner 2 had an extremely narrow non-offset temperature region of from 120° to 140° C.

Comparative Example 4

Magenta Toner 5 prepared above was subjected to Fixing Tests 1 and 2. As a result of Fixing Test 1, in Magenta Toner 5 which was a blend of Resin B, a non-linear polyester containing a side chain of soft segment monomer, and Resin C, a polyester containing a main chain of soft segment monomer, clear images were fixable even after passing not less than 2000 plain white papers. In addition, as a result of Fixing Test 2, Magenta Toner 5 had a non-offset temperature region of from 120° to 200° C. However, since the proportion of the non-linear polyester resin was high, when the formed images were fixed at a temperature of 150° C., the solid image portions had a low degree of glossiness of about 10 (found angle of incidence: 60°/60°; and amount of toner adhesion: from 0.7 to 0.8 mg/cm$^2$).

Example 2

Yellow Toner 3, Magenta Toner 3, and Cyan Toner 3 prepared above were used in a triple-color layer to carry out Fixing Test 2. As a result, when three colors were used together to form a full-color fixed image, the formed images were fixable without generating hot offset in a fixing temperature range of from 120° to 200° C. in a completely oil-free state.

Comparative Example 5

Yellow Toner 1, Magenta Toner 1, and Cyan Toner 1 prepared above were used in a triple-color layer to carry out Fixing Test 2. As a result, when three colors were used together to form a full-color fixed image, there were some practical problems in glossiness, etc. though the formed images were fixable up to a fixing temperature of 170° C. in a completely oil-free state.

Comparative Example 6

Yellow Toner 4, Magenta Toner 4, and Cyan Toner 4 prepared above were used in a triple-color layer to carry out Fixing Test 2. As a result, when three colors were used together to form a full-color fixed image, there were some practical problems in glossiness, etc. though the formed images were fixable up to a fixing temperature of 180° C. in a completely oil-free state.

Comparative Example 7

Yellow Toner 2, Magenta Toner 2, and Cyan Toner 2 prepared above were used in a triple-color layer to carry out Fixing Test 2. As a result, when three colors were used together to form a full-color fixed image, hot offset took place at any given fixing temperature in a completely oil-free state, thereby making it impossible to form fixed images thereby.

Comparative Example 8

Yellow Toner 5, Magenta Toner 5, and Cyan Toner 5 prepared above were used in a triple-color layer to carry out Fixing Test 2. As a result, when three colors were used together to form a full-color fixed image, although fixing can be carried out in a completely oil-free state in the temperature range of from 120° to 200° C., the total fixed images were not found to be glossy at a fixing temperature of 150° C., which was about a mid-fixing temperature value of the above range, and its coloring was poor, thereby making it impossible to use it as a toner for forming full-color fixed images.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for forming fixed images for full-color electrophotography, comprising the steps of:

forming an unfixed image by using three or four toners on a recording medium in single or more toner layers, colors of the toners being primary colors or primary colors and black color; and fixing by heat and pressure the unfixed image using a heat roller without a device for applying a releasing oil, wherein said toners include at least one toner for full-color electrophotography comprising:

(a) a binder resin comprising a linear polyester obtained by polymerizing one or more monomers selected from the group consisting of saturated or unsaturated, aliphatic dicarboxylic acids, acid anhydrides thereof, and lower alkyl esters thereof as an acid component, provided that the saturated aliphatic dicarboxylic acids have carbon atoms of not less than 3, that the unsaturated aliphatic dicarboxylic acids have carbon atoms of not less than 5, and that lower alkyl of the lower alkyl esters has carbon atoms of 1 to 5, the linear polyester having a softening point of from 90° C. to 1200° C. determined by a flow tester described in JIS K7210, and a non-linear polyester having a crosslinked structure and a side chain with 2 to 30 carbon atoms, wherein said non-linear polyester is present in an amount of from 5 to 25% by weight of the entire binder resin;

(b) a releasing agent comprising carnauba wax; and (c) a coloring agent.

2. The method according to claim 1, wherein said linear polyester is obtained by polymerizing one or more monomers selected from the group consisting of saturated or unsaturated, aliphatic dicarboxylic acids, acid anhydrides thereof, and lower alkyl esters thereof as an acid component in an amount of not less than 25 mol % of an entire acid component, the saturated or unsaturated, aliphatic dicarboxylic acid having a main chain with 3 to 30 carbon atoms, or having a main chain and a side chain with 3 to 30 total carbon atoms, lower alkyl of the lower alkyl esters having carbon atoms of 1 to 5.

3. The method according to claim 1, wherein said aliphatic dicarboxylic acid is selected from the group consisting of succinic acid, adipic acid, sebacic acid, and azelaic acid.

4. The method according to claim 1, wherein said linear polyester has a glass transition temperature of not less than 45° C.

5. The method according to claim 1, wherein said linear polyester has a weight-average molecular weight determined by gel permeation chromatography of from 8,000 to 30,000.

6. The method according to claim 1, wherein said linear polyester has an acid value of not more than 40 KOH mg/g and a hydroxyl value of not more than 40 KOH mg/g.

7. The method according to claim 1, wherein the content of the carnauba wax is 4 to 15 parts by weight, based on 100 parts by weight of the binder resin.

8. The method according to claim 1, wherein the content of the carnauba wax is 5 to 11 parts by weight, based on 100 parts by weight of the binder resin.

* * * * *